United States Patent [19]

Rousseau

[11] Patent Number: 4,747,026

[45] Date of Patent: May 24, 1988

[54] ELECTRIC TORCH OR FLASHLIGHT

[76] Inventor: Jean-Pierre Rousseau, 96, Rue de Miromesnil, 75008 Paris, France

[21] Appl. No.: 947,012

[22] Filed: Dec. 29, 1986

[30] Foreign Application Priority Data

Jan. 2, 1986 [FR] France ..... 86 00005

[51] Int. Cl.[4] ..... F21L 7/00

[52] U.S. Cl. ..... 362/203; 362/189

[58] Field of Search ..... 362/203, 205, 206, 189, 362/158, 188

[56] References Cited

U.S. PATENT DOCUMENTS

| | | | |
|---|---|---|---|
| 4,176,263 | 11/1979 | Rousseau | 362/203 |
| 4,392,186 | 7/1983 | Cziment | 362/205 |
| 4,433,365 | 2/1984 | Rousseau | 362/203 |
| 4,441,142 | 4/1984 | Garofalo | 362/205 |
| 4,631,646 | 12/1986 | Spindler | 362/189 |

FOREIGN PATENT DOCUMENTS 0090393 5/1983 European Pat. Off. .

*Primary Examiner*—Martin P. Schwadron
*Assistant Examiner*—Sue Hagarman
*Attorney, Agent, or Firm*—Wolder, Gross & Yavner

[57] ABSTRACT

An improved electric torch or flashlight of the type having an elongated case, a bulb and a battery source of electrical energy is disclosed. The flashlight includes a pressure-receiving surface, which may be in the form of a series of flexible segments formed of case material at an end of the case, a pressure-transmitting surface, which may be in the form of a nib at the end of a right-angle bend formed in the flexible segment, and a complementary surface, which may be a portion of the bulb. Radial pressure on the segments results in a longitudinal displacement of the complementary surface, which controls closing of the electrical circuit and illumination of the bulb.

10 Claims, 1 Drawing Sheet

ELECTRIC TORCH OR FLASHLIGHT

The invention pertains to an electric torch of the type having a case elongated along a longitudinal direction and which contains a source of electrical energy, an electric light bulb optically connected to the exterior, electrical connection means which form an electrical circuit to the light bulb from the source of electricity, and pressure-receiving means located on the outside of the case that can be manipulated by the user in order to close the electrical circuit.

In particular the present invention relates, without limitation thereby, to a pocket-size flashlight.

Numerous designs for electric torches have already been proposed. The present invention, however is designed to provide an electric torch of especially simple construction and reliable function which is convenient and efficient in operation.

In accordance with the invention, an electric torch of the type described above is distinguished by the fact that the pressure receiving means includes at least one pressure-transmitting surface designed to work together with a complementary surface of a moveable part positioned inside the case for movement along the longitudinal direction, with either the pressure-transmitting surface or the complementary surface, or both, being tilted with respect to the longitudinal direction so that exerting pressure along the radial axis on the pressure receiving means described above will cause a radial displacement of the surface and, through the interaction of the pressure-transmitting surface and its complementary surface, a longitudinal displacement of the moveable part which controls the closing of the electrical circuit and thus the illumination of the bulb.

In a preferred embodiment both the pressure transmitting surface and its complementary surface are both tilted with respect to the longitudinal direction. In such an embodiment, the pressure-receiving means is located at a longitudinal end of the case and consists of at least one strip partially cut out of the shell of the case and connected to the case at an edge, the transverse elasticity of the case being insured by the choice of material used for the case. The case can be made of metal or of molded plastic, in which case the strips can be formed during the molding process. Preferably, the strip or strips are positioned along the longitudinal direction of the case.

This case may be in the shape of a cylinder with the pressure means including several strips placed in regular intervals around the circumference of an end of the case. Preferably, each strip includes a perpendicular bend towards the interior in the radial direction, the bent portion ending in the shape of a nib and forming part of an end of the case, the tips of the nibs pointing radially towards the longitudinal axis of the case, spaced from the longitudinal axis of the case and from one another so as to outline an opening through which the bulb lens may project.

The pressure transmitting surface of each strip consists of an inclined surface forming a ramp located at the tip of each nib and positioned in a way such that a moveable part be pushed inwardly, along the longitudinal axis of the case, when radial pressure is applied to the nib.

The moveable part may advantageously be comprised of the light bulb itself, whose own axis is co-axial with the longitudinal axis of the case, the above-mentioned complementary surface being the area of the lens globe made of transparent material, this surface partially protruding through the opening at the case end outlined by the nibs of the strips. The means of electrical connection may further include a compression spring.

In a preferred embodiment, the cylindrical case is designed to carry a single battery, or the equivalent, in the shape of a cylinder, of which one pole is a central knob located at one of its ends the other pole being formed of the battery case; the bulb is then set coaxially to the case at one end of the battery, the lens globe of the bulb resting against the edge of the opening outlined by the nibs of the strips, while the spring making up the means of electrical connection between the battery case and one side of the bulb filament is in the shape of a truncated conical spiral, the end of smaller diameter holding the bulb and making the electrical connection, while the larger diameter end of the spring rests around the circumference of the end of the battery and makes the electrical connection with the second pole of the battery. When not in use, the central contact of the bulb is kept at a certain distance from the central knob of the battery due to to the aforesaid spring. When in use, however, the bulb is pushed back towards the battery so that its central contact comes into physical and thus electrical contact with the central knob of the battery, thus completing the circuit and lighting the bulb. One variation of the invention concerns the use of the battery itself as the moveable part positioned along the longitudinal axis of the case.

Preferably, the end of the case opposite the nibs of the strips is open and the battery is inserted forcibly into the case; longitudinal ribs radially pointing toward the interior of the case along the inner case circumference advantageously insure a grip on the battery forcibly inserted into the case.

The foregoing features, along with additional features and advantages of the present invention, will become apparent upon review of the following description of a preferred, but nonetheless illustrative embodiment of the invention taken in conjunction with the annexed figures, wherein.

Figure 1:
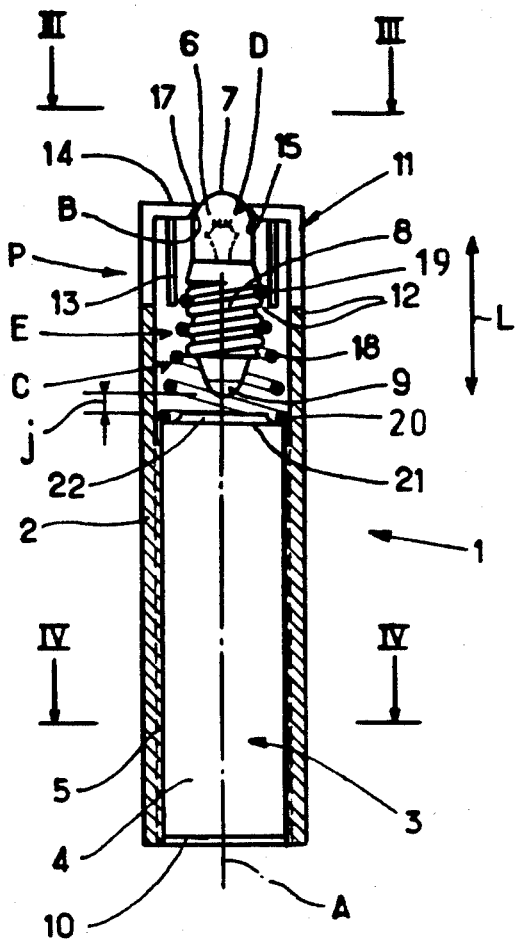
FIG. 1 is a cross-section of the device along the longitudinal axis when the torch is not in use.

According to the drawing, specifically FIG. 1, the depicted object is a pocket-size flashlight. Although the invention is particularly well-suited to electric torches of such a small size, it is obviously not restricted to applications of such dimensions and is suitable to larger electric torches.

Figure 4:
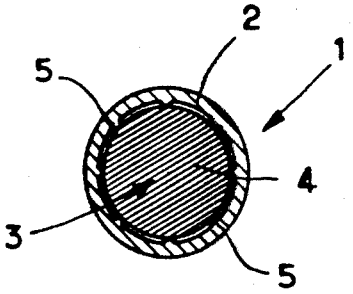
FIG. 4 is a cross-section taken along the line IV—IV of FIG. 1.

The electric torch 1 includes a case 2 elongated along a longitudinal direction symbolized by a double-pointed arrow L on FIG. 1. More precisely, in the example depicted on FIG. 1, the case 2 is a cylinder with an axis of revolution A. For the greatest advantage, this case is molded in plastic. A source of electrical energy 3, preferably consisting of an alkaline battery 4, is carried inside the case 2, whose inner diameter is such that it will keep a tight grip on the cylindrical surface of the battery 4. For the greatest advantage, longitudinal ribs 5 (FIG. 4) protrude on the inside of the case and contribute to the radial grip, thus holding the battery 4 in place. These ribs 5 are placed regularly around the internal circumference and may be eight in number. Their cross-section can be in a dihedral shape whose outer edge is parallel to the generating lines of the cylindrical case 2 and comes in contact with the wall of the battery 4.

A light bulb 6, optically connected to the exterior, is also carried inside the case 2. By "optically connected to the exterior," it is to be understood that the bulb is set so that the light it emits when electrically fed will propagate to the case exterior and will provide the desired lighting. This bulb 6 consists, as usual, of a lens or globe 7 made of transparent material encasing the electrical filament; this globe 7 is sealed to the metallic shell 8 of the bulb, which may be externally threaded, which makes up the first contact electrically connected to the filament; the extremity of the bulb 6 opposite the globe 7 includes in its middle part a central stud 9 that is electrically insulated from shell 8 and makes up the second contact electrically connected to the other end of the filament.

Pressure-receiving means P located on the case 2 is utilized by the user to control the closing of the electrical circuit that includes connection means C so as to cause the illumination of the bulb 6. Pressure-receiving means P, directed towards the inside of the case, includes at least one pressure-transmitting surface B designed to work together with complementary surface D of a moveable part positioned inside the case 2 along the longitudinal direction L. Either pressure-transmitting surface B or the complementary surface D, or both, are tilted with respect to the longitudinal direction L so that exerting pressure along the radial direction R (FIG. 2) on the pressure means described above will cause a radial displacement of the pressure-transmitting surface B and, through the interaction of this surface and its complementary surface D, a longitudinal displacement of the moveable part E that controls the closing of the electrical circuit and thus the illumination of the bulb 6.

Preferably, the pressure-transmitting surface B and its complementary surface D are both tilted with respect to the longitudinal direction L.

According to the specific embodiment depicted in FIGS. 1–4, part E consists of the bulb 6 whose axis is coaxial with the longitudinal axis A of the case 2. The bulb is located proximate on end of the battery 4, coaxially to the battery.

Figure 2:
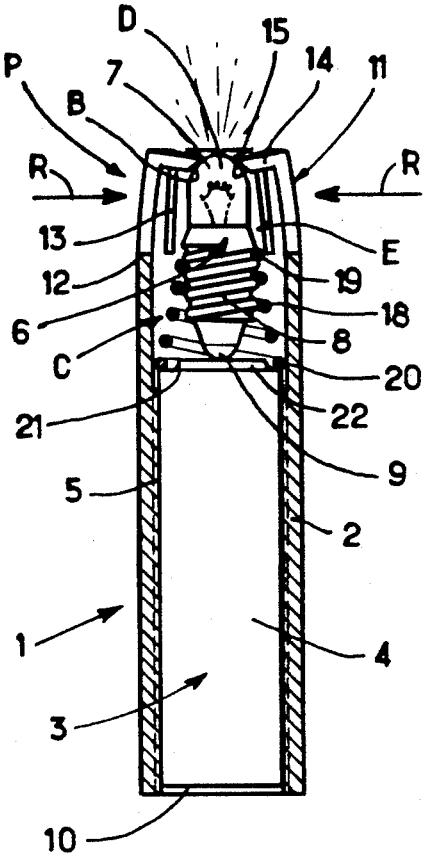
FIG. 2 is a cross-section similar to that of FIG. 1, but while the bulb is illuminated.

For the greatest advantage, the pressure means P are located at one of the longitudinal ends of the case 2, the top end according to FIGS. 1 and 2, while the other end 10 of the case remains open for battery insertion.

Pressure means P includes, in the depicted embodiment, several strips 11 partially cut out in the cylindrical shell of the case 2 and connected to the case at then lower edges 12 as seen in FIGS. 1 and 2. The phrase "cut out" should obviously be understood as a non-binding definition for the way the strips are separated from one another by grooves or slits 13, which can be directly derived from the molding process and which do not require a cutting process. Alternative means of construction, however, are equally acceptable. The strips 11 together with the grooves are positioned along the longitudinal direction L.

Transverse or radial elasticity of each strip, along direction R, can be insured by the use of an appropriate material for the case. The strips 11 are placed regularly along the circumference of the case; in this illustrated embodiment are eight such strips.

Figure 3:
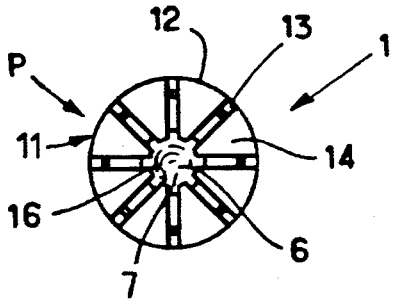
FIG. 3 is a top view of the device with respect to diagram 1, along the line III—III of said FIG. 1.

Each strip 11 includes a perpendicular bend towards the axis A of the case in the radial direction, each strip ending in a nib 14 which form a portion of the end of the case. As seen in FIG. 3, each nib 14 may be in the shape of a circular sector, all of which are contained within a plane perpendicular to axis A. The tips 15 of the nibs are pointed radially towards the Case axis A, and end at a distance from the axis A of the case and from one another so as to outline a circular opening 16 (see FIG. 3).

The pressure-transmitting surface B, for each strip consists of an inclined ramp-forming surface 17 located at the tip 15 of each nib. This surface 17 is directed away from axis A as one goes towards the inside of the case 2 along direction L. The set of surfaces 17 defines a truncated conical crown about axis A, whose vertex lies outside case 2. The complementary surface D consists of the convex surface of the globe 7 of the bulb and, more specifically, the portion of the convex surface in contact with the surfaces 17. This portion of the surface of the globe 7 is also tilted with respect to axis A as globe 7 may be in the shape of a hemisphere. The convex surface of globe 7 partially protrudes through the opening 16 outlined by the nibs 14.

The means of electrical connection C include a compression spring 18 in the shape of a truncated conical spiral. The smaller diameter end 19 of this spring holds bulb 6 in place. The shell 8 can be contained within the turns of the spring 18. As a variation, the bulb could also rest against the end of smaller diameter of the spring, with only the truncated conical part of the insulator, which separates the central stud 9 from the shell 8, inserted within the spring. The larger diameter end 20 of this spring rests on the circumference 21 of the upper end of the battery 4 and connects electrically with this circumference 21 which normally defines the negative pole or terminal of the battery. The other pole of this battery is defined by a central knob 22, electrically insulated from the shell and located on the end of the battery closer to the bulb 6. When not in use, the circuit is open, the knob 22 and the central stud 9 of the bulb being kept at a distance j from each other (FIG. 1) by spring 18. When in use (FIG. 2), the central stud 9 comes into physical and thus electrical contact with the central knob 22.

The assembly of the electric torch depicted in FIGS. 1 through 4 comes as direct result of the above explanations:

Once the shell 8 of the bulb 6 is engaged with the turns of the spring 18, through the smaller diameter end 19 thereof, the assembly thus created is inserted in the case 2 through its open end 10 so that the globe 7 of the bulb touches the nibs 14 and slightly protrudes through the opening 16. The battery is then inserted, correctly positioned within the case to the appropriate depth. The battery is held in place by the grip of the case. This yields an electric torch of particularly simple and effective design since it is made of only four parts.

When not in use, the nibs 14 are relatively distant from one another, as depicted in FIGS. 1 and 3, bulb central stud 9 is separated from battery knob 22. Thus the bulb 6 is not illuminated.

When the user wants to cause the illumination of the bulb 6, he will simply exert a radial pressure towards the axis A as shown in FIG. 2 by the arrows R, on at least one strip 11 to cause bulb 6 to move downward against the spring 18 in order to bring the central stud 9 in contact with knob 22. The radial pressure applied to the strips 11 and their nibs 14 is transformed into a longitudinal force through the interaction of the pressure-transmitting surface B and its complementary surface D.

In practice, the user applies pressure to at least two diametrically opposed strips 11 by squeezing the tip of the case 2 between thumb and forefinger. In effect, holding the case 2 in the palm of one's hand while squeezing the stripped tip of the case will insure an action on all or most of the strips 11. Obviously, holding the case in the palm of the hand and causing illumination by applying pressure to the tip of the case are particularly simple and practical maneuvers that allow for a good electrical connection.

A lens bulb can be used as bulb 6. Preferably, the types of bulb 6 and battery 4 are chosen so that the bulb 6 can be illuminated with a single battery. As a rule, when the battery 4 is worn out, it need not be replaced. The torch can be disposed of since it costs only slightly more than the battery.

As soon as pressure along the arrows R is released, the bulb 6 is pushed back by the spring 18, so that the circuit opens, switching off the bulb. The strength of the spring 18 is chosen such that there can be no ill-timed switching on of the torch, i.e. in the pocket of the user where the torch might fall under the weight of another object.

It is to be recognized that the embodiment 1 through 4 is merely illustrative, and the numerous variations of the invention are possible while remaining within the boundaries of the invention. For example, and not by limitation, the moveable part E positioned along the longitudinal direction L could be formed of the battery 4 itself, the displacement of this battery being also caused by the transformation of a radial pressure into a longitudinal force.

What is claimed:

1. An electric torch, comprising a case elongated along a longitudinal direction, a source of electrical energy mounted therein, an electric light bulb optically connected to the case exterior and supported at one end of said case, means of electrical connection to form an electrical circuit to the bulb from the source of electricity, and pressure means located at one of the longitudinal ends of the case, said pressure means being able to be manipulated by the user to close the electrical circuit, said means including at least one pressure-transmitting surface in the form of at least one strip partially cut out of the shell of said case connected to said case at an edge thereof, a complementary surface means positioned in the case movable along a longitudinal direction, at least one of said pressure-transmitting and said complementary surface means being tilted with respect to the longitudinal direction so that pressure exerted along the radial direction on said pressure means causes a radial displacement of said pressure-transmitting surface and, through the interaction of said pressure-transmitting surface with said complementary surface means, a longitudinal displacement of said complementary surface means to close the electrical circuit to illuminate the bulb.

2. The torch of claim 1, wherein said strips are oriented along the longitudinal direction of the case.

3. The torch of claim 2, wherein said torch has a cylindrical case, said pressure means consists of a plurality of strips located about the circumference of the end of the case, each strip having a perpendicular bend towards the longitudinal axis of the case ending in a nib and forming part of an end of the case, the tips of the nibs pointing radially towards the longitudinal axis of the case at a distance therefrom and from one another so as to outline an opening.

4. The torch of claim 3, wherein the pressure-receiving surface of each strip consists of an inclined, ramp-forming surface at the tip of each nib, said inclined surfaces each being positioned and oriented such that said complementary surface means is pushed towards the inside of the case when radial pressure is applied to the nib.

5. The torch of claim 4 wherein said bulb comprises a filament-covering globe projecting upwardly from a shell and a central bottom stud, said shell and stud each electrically connected to opposite ends of a filament within said globe, said complementary surface comprising a portion of said globe.

6. The torch of claim 5 wherein said globe partially protrudes through the opening outlined by said strip nibs.

7. The torch of claim 6 wherein said electrical connection means comprises a compression spring.

8. The torch of claim 7 wherein said battery includes a central knob located at one of its ends for a first pole, said bulb being coaxial with said case said first pole end of the battery, said globe resting against the edge of the opening outlined by said strip nibs, said spring being in the shape of a truncated conical spiral, the smaller diameter end of which holding the bulb in place and making the electrical connection, the larger diameter end of which resting around the circumference of the end of the battery surrounding said central knob and making electrical connection with the second pole of the battery, the central stud of the bulb spaced from the central knob of the battery by said spring, said bulb being moveable towards the battery so that the central stud comes into electrical contact with the central knob of the battery to complete the electrical circuit.

9. The torch of claim 3 wherein the end of the case opposite the nibs of the strips is open for battery insertion, the diameter of said case being dimensioned to retain the battery therein.

10. The torch of claim 9 wherein said case includes an inner surface having longitudinal ribs adapted to retain the battery within the case.

* * * * *